US010887696B2

(12) United States Patent
Trommer

(10) Patent No.: US 10,887,696 B2
(45) Date of Patent: Jan. 5, 2021

(54) WIRELESS HANDSET

(71) Applicant: Sennheiser electronic GmbH & Co. KG, Wedemark (DE)

(72) Inventor: Thomas Trommer, Hannover (DE)

(73) Assignee: Sennheiser electronic GmbH & Co, KG, Wedemark (DE)

( * ) Notice: Subject to any disclaimer, the term of this patent is extended or adjusted under 35 U.S.C. 154(b) by 0 days.

(21) Appl. No.: 16/717,137

(22) Filed: Dec. 17, 2019

(65) Prior Publication Data

US 2020/0221228 A1 Jul. 9, 2020

(30) Foreign Application Priority Data

Jan. 4, 2019 (DE) ..... 10 2019 100 104

(51) Int. Cl.

| | |
|---|---|
| ***H04R 5/02*** | (2006.01) |
| ***H04R 5/033*** | (2006.01) |
| ***H04R 5/04*** | (2006.01) |
| ***H04R 1/10*** | (2006.01) |

(52) U.S. Cl.

CPC ..... *H04R 5/033* (2013.01); *H04R 1/1025* (2013.01); *H04R 1/1033* (2013.01); *H04R 1/1041* (2013.01); *H04R 5/04* (2013.01); *H04R 2420/07* (2013.01)

(58) Field of Classification Search

CPC ..... H04R 5/02

See application file for complete search history.

(56) References Cited

U.S. PATENT DOCUMENTS

| | | | | |
|---|---|---|---|---|
| 9,013,145 | B2 | 4/2015 | Castillo et al. | |
| 2016/0134961 | A1* | 5/2016 | Shaffer | H04R 1/1016 381/74 |
| 2017/0104352 | A1 | 4/2017 | Stratton et al. | |
| 2018/0124494 | A1* | 5/2018 | Cheney | H04R 1/105 |
| 2018/0184191 | A1* | 6/2018 | Kim | H04R 1/1041 |

FOREIGN PATENT DOCUMENTS

| | | |
|---|---|---|
| CN | 106981907 | 7/2017 |
| CN | 207218994 | 4/2018 |
| DE | 102009030070 | 12/2010 |
| KR | 101687678 | 12/2016 |
| KR | 101966413 | 4/2019 |

* cited by examiner

*Primary Examiner* — Olisa Anwah

(74) *Attorney, Agent, or Firm* — Haug Partners LLP

(57) ABSTRACT

A wireless headphone including two wireless earphones and a charging band. In normal operation, the wireless earphones are each worn in an ear of a user and are not connected to each other via cables, and each include a first rechargeable battery. When the first rechargeable batteries are running low, the charging band can be connected to the wireless earphones so as to recharge the first rechargeable batteries on the go without interrupting the use of the wireless earphones.

9 Claims, 5 Drawing Sheets

WIRELESS HANDSET

The present application claims priority from German Application No. 10 2019 100 104.8 filed on Jan. 4, 2019, the disclosure of which is incorporated by reference in its entirety.

FIELD OF THE INVENTION

The present invention relates to a wireless headphone.

BACKGROUND

Wireless headphones in the form of, for example, wireless in-ear headphones are well known. The music to be played is transmitted wirelessly, for example via a Bluetooth protocol. Headphones whose sound transducers for the left and the right ear are not connected to each other by cable are called "True Wireless" headphones. The transducers for the left and the right ear are then independent of each other and may each establish a wireless connection with a transmitter in order to be able to play an audio signal to be played.

U.S. Pat. No. 9,013,145 discloses wireless in-ear headphones that are not connected via cable. The respective transducers comprise a rechargeable battery each and can be recharged independently of each other in a charger.

The capacity of the rechargeable battery unit for the transducer determines the maximum operating time of the wireless in-ear headphones.

After the energy in the battery unit has been used up, the battery unit must be recharged. For this purpose, the transducer is typically placed in a charger.

In the German priority document, the German Patent and Trademark Office (DPMA) has cited the following documents. KR 101687678 B1, CN 207218994 U, CN 106981907 A, US 2018124494 A1, US 2018184191 A1, KR 101966413 B1, US 2017104352 A1 and DE 102009030070 A1.

SUMMARY OF THE INVENTION

It is an object of the present invention to provide a wireless headphone that allows a more convenient charging.

This object is solved by a wireless headphone according to claim 1.

Thus, a wireless headphone, in particular a wireless in-ear headphone, is provided. The wireless headphone has two wireless earphones, each of which can be attached in or on an ear of a user and comprises at least an electro-acoustic transducer for reproduction, a wireless transmitter/receiver, a first rechargeable battery and at least one charging input. The wireless transmitters/receivers of the two wireless earphones may, independent from each other, wirelessly receive an audio signal to be replayed. Optionally, the two transmit/receive units may communicate wirelessly with each other. The charging inputs of the first and second wireless earphones may each be coupled to a charging outlet of a charging band. The charging band has at least one second battery that may be rechargeable. At each end of the charging band, a charging outlet is provided which may interact with the charging inputs of the wireless earphones in order to transfer energy from the second battery to the respective first rechargeable batteries in the wireless earphones, so as to recharge the first rechargeable batteries.

Thus, for example a neck band having a battery is provided that allows recharging the first rechargeable batteries of the two wireless earphones while wearing them.

According to the invention, this may enable in-situ recharging of the wireless headphone.

If the battery of the charging band is rechargeable and empty, then it may be recharged by a charger, for example. The charger may also serve for recharging the rechargeable batteries of the wireless headphone. The charger may be designed as a transport box.

According to an aspect of the present invention, the charging inputs of the wireless earphones and the charging outlets of the band are equipped with electrical contacts, so that charging of the rechargeable batteries in the wireless earphones may be done purely electrically.

According to an aspect of the present invention, the energy transfer between the charging outlets and the charging inputs may be done contactless, e.g. inductively or capacitively, so that no electrical contact is required for charging the rechargeable batteries of the wireless earphones.

Optionally, magnets may be provided for attaching the charging outlets of the charging band each to a charging input of the wireless earphones.

According to an aspect of the present invention, the charging band with the second battery serves for charging the first rechargeable batteries of the wireless earphones. Optionally, the charging band may additionally transmit audio.

According to an aspect of the present invention, the connections between the charging outlets and the charging inputs may be realized by a plug connection.

Due to the mechanical or magnetically reinforced connection between the charging outlets and the charging inputs, the charging band can also be used for mechanically holding the wireless earphones if one of the wireless earphones is not attached in or on the ear. This holds particularly if the wireless headphone is an in-ear headphone. In this case, the wireless earphone that is not in the ear may dangle from the charging band.

The wireless headphone according to the invention is in particular advantageous because recharging the rechargeable batteries of the wireless earphones may be done while the wireless headphone is being worn and used. In other words, the wireless headphone may be used for example for replaying audio signals even while the rechargeable batteries of the wireless earphones are being charged. This is not possible with conventional True-Wireless headphones. An in-ear headphone cannot be used for replaying audio while being recharged in a charger.

Further, the operating time of the wireless headphone may be substantially increased, according to the invention, since in addition to the rechargeable batteries within the wireless earphones, also the battery in the charging band may be used for providing energy to the electro-acoustical transducers and the wireless transmitters/receivers.

Further embodiments of the invention are subject of the dependent claims.

BRIEF DESCRIPTION OF THE DRAWINGS

Advantages and embodiments of the invention are described in more detail below, with reference to the drawings.

DETAILED DESCRIPTION OF THE INVENTION

Figure 1:
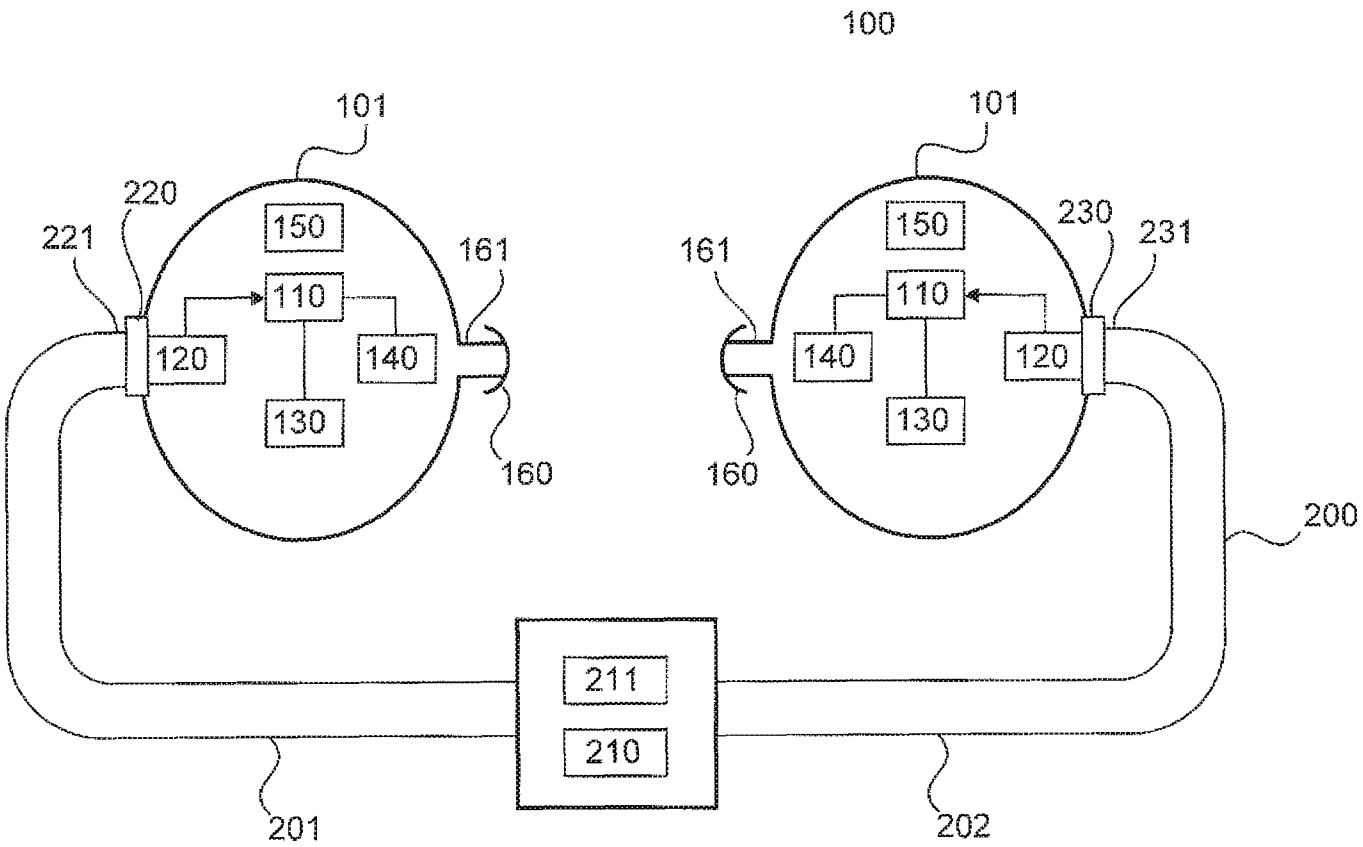
FIG. 1 shows a schematic representation of a wireless headphone according to the invention.

FIG. 1 shows a schematic representation of a wireless headphone according to the invention. The wireless headphone shown in FIG. 1 consists of two wireless earphones 101 and a charging band 200.

The wireless headphone 100 has two wireless earphones 101, which each have a first rechargeable battery 110, at least one first charging input 120, an electro-acoustical transducer 140 for reproduction, a control unit 130 and a wireless transmitter/receiver 150. The control unit 130 may be implemented as control electronics with a processor. Each wireless earphone 101 has a sound outlet 161 on which an earpad 160 may be provided that is insertable into an ear or an ear canal of a user. The two wireless earphones 101 are connected to each other by a charging band 200. The charging band 200 has a second battery 210, control electronics 211 and a first and a second end 221,231. The second battery 210 is connected by cables 201,202 respectively, each with an end 221,231 of the charging band. At each of the ends 221,231 a charging outlet 220,230 is provided, which may interact with a charging input 120 of the wireless earphone 101. The charging outlets 220,230 and the charging inputs 120 may be equipped with electrical charging contacts in order to allow an electrical transmission for recharging the first rechargeable batteries 110 from the second battery 210. The connection between the charging outlets 220,230 and the charging inputs 120 is made detachable so that the band 200 may be removed from the wireless earphones 101.

The charging inputs 120 and the charging outlets 220,230 may have electrical contacts for energy transmission. Alternatively, contactless energy transmission may be employed, e.g. inductively or capacitively.

The mechanical connection between the charging outlets 220, 230 and the charging inputs 120 may be reinforced preferably by magnets. Alternatively, a plug connection may be used here.

The charging band 200 thus serves for recharging the first rechargeable batteries 110 in the wireless earphones 101. Further, the charging band 200 can be used for the wireless earphones 101 to be detachably attached to the charging band's ends 221,231. This may prevent a wireless earphone from being lost after being removed from the ear, since it is attached to the charging band 200.

Further, communication may be realized through the connection between the charging outlets 220,230 and the charging inputs 120, meaning an exchange of information via a data channel each between the control unit 130 of a wireless earphone and the control electronics 211 of the charging band.

Figure 2:
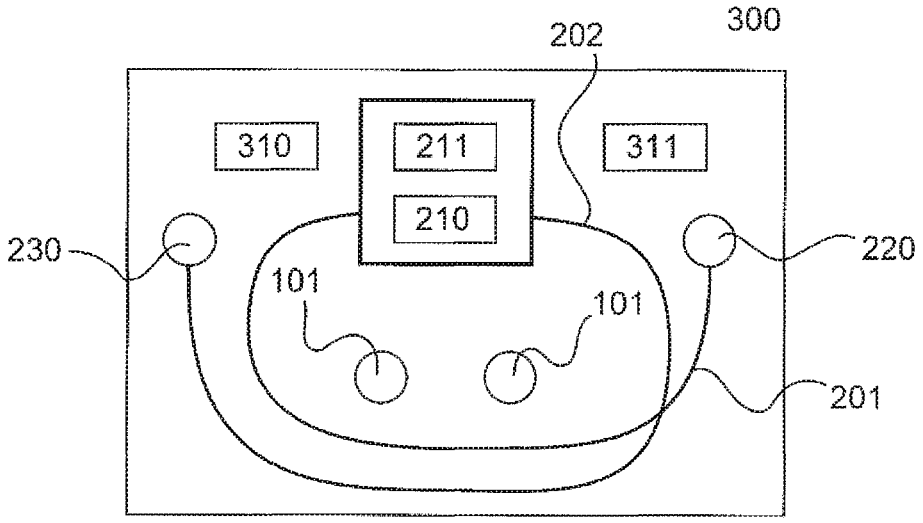
FIG. 2 shows a schematic representation of a charger for a wireless headphone according to FIG. 1, FIG. 3A each show a schematic representation of a wireless earphone and 3B according to an embodiment of the invention, FIG. 4A each show a representation of a wireless earphone according to an and 4B embodiment of the invention, FIG. 5A each show a representation of a wireless earphone according to an and 5B embodiment of the invention while being inserted into an ear.

FIG. 2 shows a schematic representation of a charging station for a wireless headphone according to FIG. 1. The charging station 300 serves for recharging the rechargeable batteries of the wireless earphones 101 and the battery 210 of the charging band 200, which is rechargeable in this case. Each wireless earphone 101 and the charging band can each be charged separately in the charging station 300. Optionally, the charging station 300 may have at least one third battery 310 to enable mobile charging of the wireless earphones 101 and/or of the charging band 200. Further, the charging station 300 comprises control electronics 311. If the wireless earphones 101 and/or the band 200 are in the charging station 300, they may be charged simultaneously, namely either from the third battery 310 or via a power supply connected to it.

The charging station 300 may also be a storage or transport box.

The wireless earphones 101 are each self-sufficient, so that they have a separate power supply and a separate wireless transmitter/receiver each. Thus, the wireless earphones 101 may be operated independent from each other.

The power in the two first rechargeable batteries 110 and the power in the second battery 210 may be used for increasing the battery runtime of the wireless headphone if the charging inputs 120 of the two wireless earphones 101 are coupled to the charging outlets 220,230 of the charging band 200, so that the two first rechargeable batteries 110 may be recharged via the second battery 210.

Figure 3A:
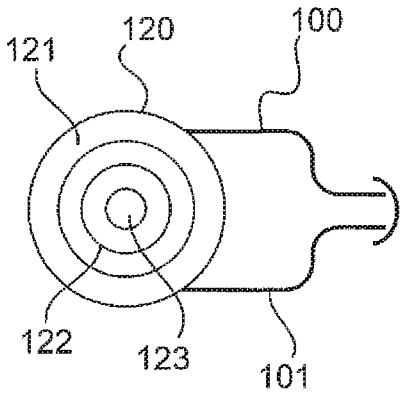
Figure 3B:
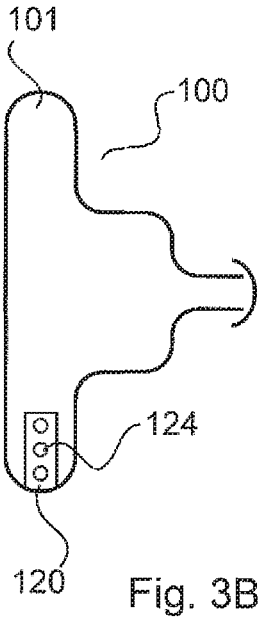

FIGS. 3A and 3B each show a schematic representation of a wireless earphone according to an embodiment of the invention. As shown in FIG. 3A, the first charging contacts may have a plurality of contacts 121-123 that are isolated from each other and may be formed as concentric circles or rings, for example. The connections 121-123 may be used e.g. for the supply/charging power, a data channel, an audio signal and the common ground.

Alternatively or additionally, other electrical contacts 124 may be provided, e.g. as shown in FIG. 3B.

Alternatively or additionally, the energy transmission and/or the data transmission between a charging outlet and a charging input may be inductive or capacitive.

With the wireless headphone according to the invention, recharging the first rechargeable batteries 110 may happen during operation of the wireless headphone, i.e. while the wireless headphone wirelessly receives and reproduces via the reproduction transducers an audio signal.

Using the charging band 200, wireless headphones may be connected to each other mechanically (and in an embodiment also electrically) in order to avoid losing the respective wireless earphones. Thus, in addition to the mechanical attachment, also recharging the first rechargeable batteries 110 of the wireless earphones 101 may be done on the go and during operation, due to the second battery 210 provided in or on the charging band 200. For this purpose, the cables 201,202 of the charging band 200 may be a multicore electrical cable or comprise such cable.

With corresponding charging electronics, the first rechargeable batteries 110 may be charged very quickly if connected to the charging band 200. For example, a playback time between 1 and 3 hours may be achieved by a 15 minute charge of the first rechargeable batteries 110. Thus, by using the invention it is possible to recharge the rechargeable batteries of the wireless earphones very quickly and during operation of the headphone. Therefore, the wireless earphones do not need to be placed in the charging station as usual in order to be charged. Different from the state-of-the-art situation, the wireless earphones 101 may continue to be operated while their first rechargeable batteries 110 are being charged.

The charging band according to the invention may substantially increase the operating time of the wireless headphone. Furthermore, the wireless headphone may be worn and used for audio reproduction while being charged.

Figure 4A:
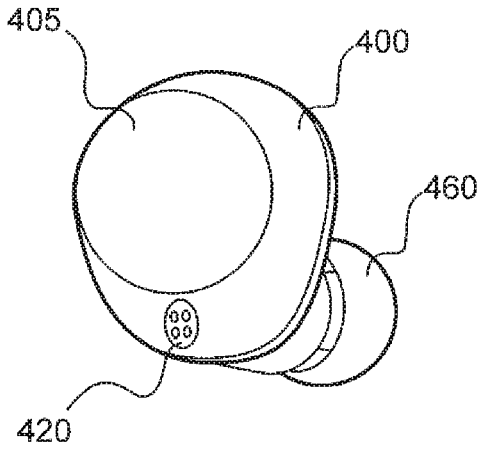
Figure 4B:
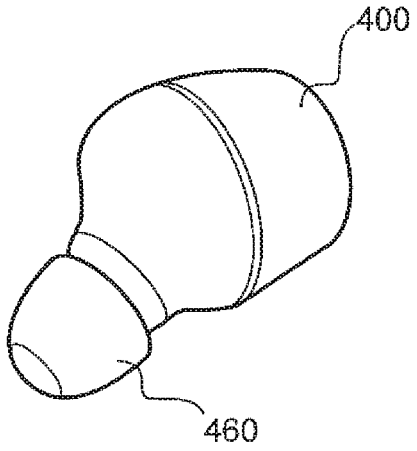

FIG. 4A shows a representation of a wireless earphone according to an embodiment of the invention. The wireless earphone 400 is equipped like a wireless earphone 101 described above. It has a charging input 420 and an earpad 460. In FIG. 4A, the wireless earphone 400 is depicted in a form that could be inserted into a real ear, wherein the form for a user's right ear is depicted here. It can be seen, in particular, that the charging input 420 is located on a side of the wireless earphone 400 that is opposite the earpad 460. In this way, the charging input is accessible also when the wireless earphone 400 is inserted into a user's ear for use. Optionally, a control surface 405 is provided on the outside of the wireless earphone 400 that is also accessible during use. The charging input 420 is then provided next to the control surface 405. FIG. 4B shows a further representation of the wireless earphone 400 of FIG. 4A from a different perspective.

Figure 5A:
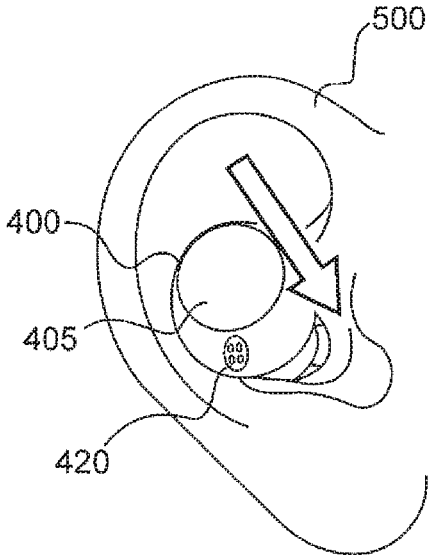
Figure 5B:
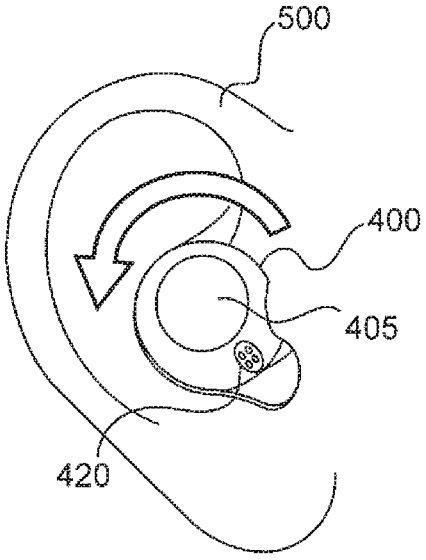

FIG. 5A shows the wireless earphone 400 from FIG. 4A when being inserted into an ear 500 of a user. FIG. 5B shows the wireless earphone 400 from FIG. 4A as it is inserted into a user's right ear 500 during normal use. The control surface 405 as well as the charging input 420, according to the invention, remain accessible. Preferably, the charging input 420 is directed approximately towards the user's mouth.

Figure 6:
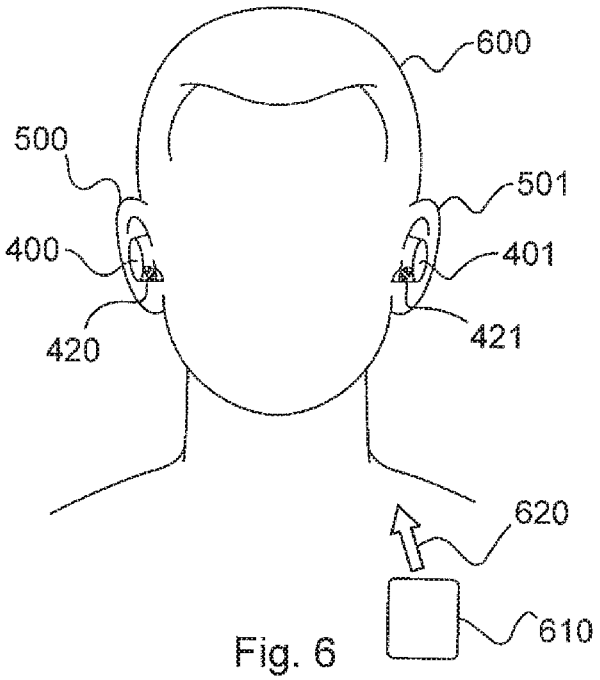
FIG. 6 shows a representation of using wireless earphones according to the invention in normal operation.

FIG. 6 shows a representation of the use of wireless earphones according to the invention in normal operation. In normal operation, a right wireless earphone 400 with a charging input 420 is in the right ear 500 of a user 600, and a left wireless earphone 401 with a charging input 421 is in the left ear 501 of the user 600. The charging inputs of both wireless earphones 400,401 are accessible. An audio signal 620 is wirelessly transmitted from an external device 610 to both wireless earphones 400,401. The external device 610 may be a smartphone. The wireless transmission of the audio signal may be a Bluetooth connection. The audio signal may be a stereo signal that optionally is transmitted from the external device 610 directly to only one of the two wireless earphones 400. In this case, this wireless earphone transmits the portion of the audio signal that is determined for the other ear wirelessly to the other wireless earphone 401. If provided for by the wireless transmission protocol of the external device 610, it is also possible to transmit the respective portions of the stereo signal directly from the external device 610 to the two wireless earphones 400,401.

Figure 7:
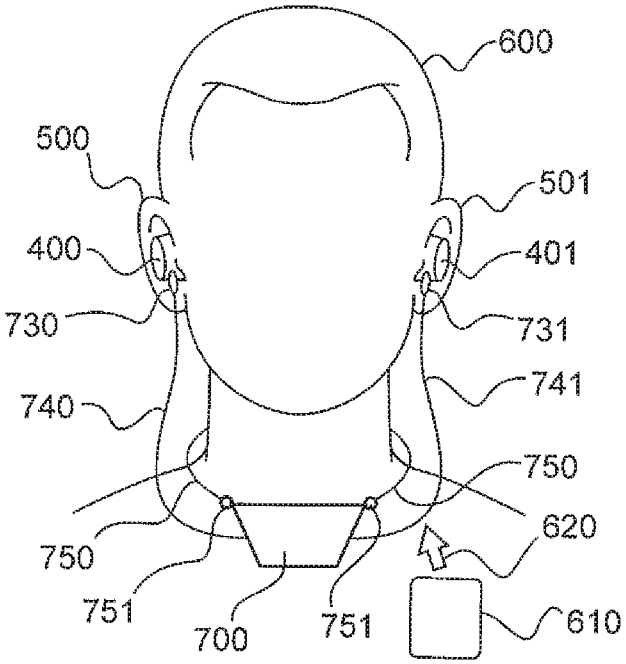
FIG. 7 shows a representation of using wireless earphones according to the invention in charging operation, using a charging band according to the invention.

FIG. 7 shows a representation of the use of wireless earphones according to the invention in charging operation, using a charging band according to the invention. The wireless earphones 400,401 continue to be in the ears 500,501 and continue to receive the audio signal 620 wirelessly from the external device 610 and output it to the user. Connected to the charging inputs are now the charging outlets 730 and 731 of the charging band. The charging band is equipped like the charging band 200 described above. It comprises a housing 700 and cables 740,741 having the charging outlets 730,731. Optionally, the charging band is equipped with a fixing device 751. In FIG. 7, two eyelets 751 are depicted here by way of example, to which a chain 750 may be attached with which the user 600 may hang the housing 700 around his neck. Alternatively, the fixing device 751 can also be a clip that can be fastened to the user's clothing. Other alternatives for the fixing device 751 are possible. As further examples, a headband, a collar, a rear headband or ear hooks that go behind the ears are being mentioned.

Figure 8:
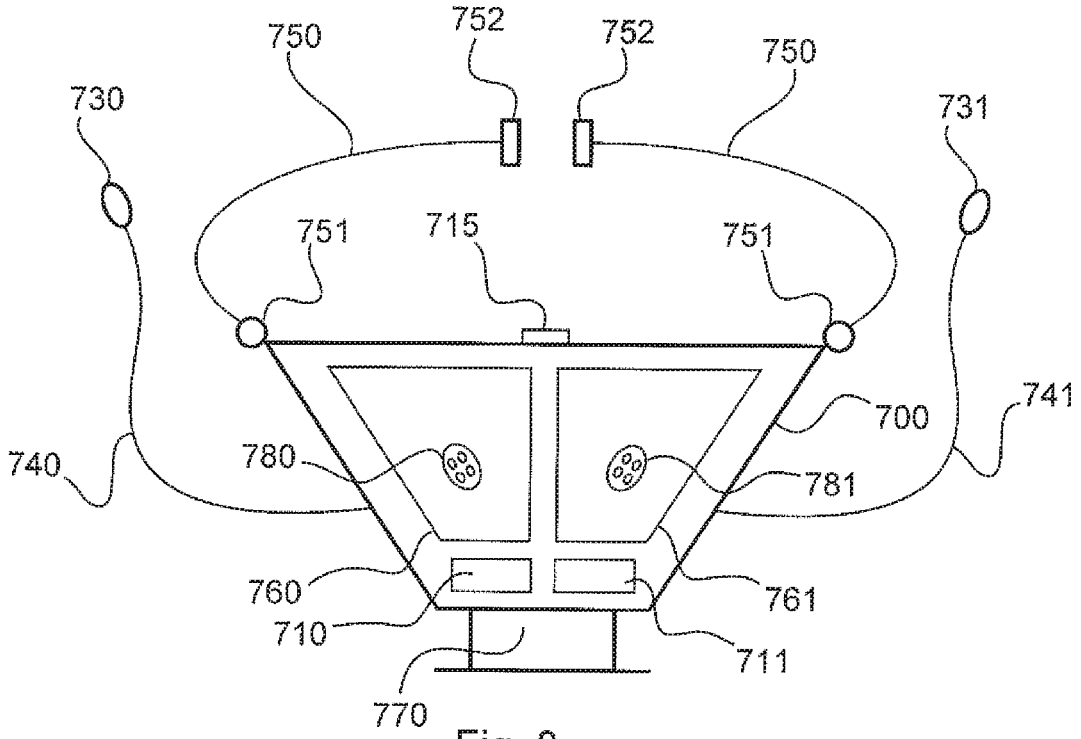
FIG. 8 shows a charging band according to the invention that is also a charger.

FIG. 8 shows a charging band according to the invention that is simultaneously also a charging station. It is equipped like the charging band from FIG. 7. Thus, the housing 700 contains a second battery 710 (corresponding to the second battery 210) and control electronics 711 (corresponding to control electronics 211). Additionally, it has a recess 760 for receiving the right wireless earphone 400 and a recess 761 for receiving the left wireless earphone 401. The recesses 760,761 each have a transport charging outlet 780, 781. When a wireless earphone 400,401 is inserted into its respective recess 760,761, the respective charging input 420,421 is connected with the respective transport charging outlet 780,781 so that mobile charging of the first rechargeable batteries 110 contained within the wireless earphones 400,401 from the second battery 710 is effected.

Furthermore, FIG. 8 shows an access 715 with which the housing 700 can be connected to an external power source for recharging the battery 710 and, possibly simultaneously, the first rechargeable batteries 110 in the wireless earphones 400,401. If the charging band is not connected to an external power source, the first rechargeable batteries 110 in the earphones 400,401 are being charged from the second battery 710. Also the energy transmission from the external power source to the charging band may be either via electrical charging contacts or contactless, e.g. inductive or capacitive.

The chain 750 optionally has a closure 752.

In addition, the housing 700 has a winding portion 770 that may receive the cables 740, 741 during transport. With the recesses 760 and 761, the charging band from FIG. 8 simultaneously serves as a mobile charging station. That is, the user may insert his wireless earphones 400,401 into the housing 700, as known in the art, for recharging them on the go. However, according to the invention, he can alternatively keep the wireless earphones 400,401 in the ears and continue to use them for listening to the wirelessly transmitted audio signals 620 while simultaneously performing mobile charging from the second battery 710 in the charging band. Since the charging band in this embodiment is simultaneously a charging station/transport box, the user does not need any additional device or container for stowing his wireless earphones 400,401 for mobile charging after usage.

Optionally, the housing 700 may have a lockable cover (not shown).

Figure 9:
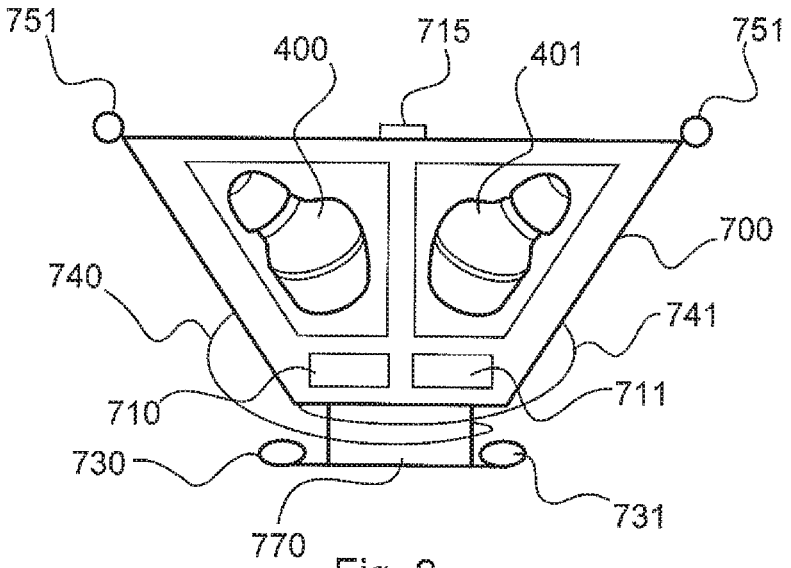
FIG. 9 shows the charging band of FIG. 8 with inserted earphones in transport state.

FIG. 9 shows the charging band from FIG. 8 with inserted earphones 400,401 in transport state. The first rechargeable batteries in the inserted wireless earphones 400,401 can then be charged on the go from the second battery 710. The cables 740 and 741 are wound up in the winding portion 770. The charging outlets 730 and 731 may be fixed in the winding portion, e.g. with magnets.

Optionally, the charging outlets 730,731 and the transport charging outlets 780,781 may be configured such that the control units 130 in the wireless earphones 400,401 may detect whether they are being charged from a charging outlet 730,731 or from a transport charging outlet 780,781. This may be implemented using data transmission through the corresponding connection, for example. The control unit 130 may control the wireless earphone 400,401 to switch itself off in order to save energy when there is contact with a transport charging outlet 780,781. When the headphone is in the transport box 700, the output of an audio signal is not necessary. However, if the control unit 130 detects that the wireless earphone 400,401 is connected with a charging outlet 730,731, it does not switch off the wireless earphone 400,401 so that the user can continue to listen to his audio signal while the first rechargeable batteries 110 are being charged.

True-Wireless earphones are intended for use without cables, as shown in FIG. 6. The mobile charging according to FIG. 7 enables a continued use of the headphones while they are recharged on the go. In order to be able to switch into normal operation mode as soon as possible, the control unit 130 may optionally output, via the electro-acoustic transducer 140 for reproduction, an acoustic signal to the user when the charging of the first rechargeable batteries 110 via the charging outlets is completed. The user may then remove the charging band again.

The second battery 210,710 in the charging band may be configured to be exchangeable by the user. In this way, the user may continue to use his wireless earphones 400,401 on the go even if the second battery 210,710 in the charging band is also empty. He exchanges then the empty second battery 210,710 against a charged battery, so that subsequently the charging band is available again for mobile charging of the wireless earphones 400,401 during use. The second battery 210,710 may optionally be a rechargeable or a non-rechargeable battery.

The invention claimed is:

1. A wireless headphone comprising:
two wireless earphones, each comprising:
a first rechargeable battery;
at least one electro-acoustic transducer for reproduction;
at least one charging input; and
at least one wireless transmitter/receiver; and
a charging band comprising a second battery,
wherein charging outlets are located on a first end and a second end of the charging band,
wherein the charging outlets and the charging inputs are adapted for charging the first rechargeable batteries from the second battery;
wherein the charging band is configured to serve as a transport box for the two wireless earphones,
wherein the charging band enables mobile charging of the two wireless earphones within the transport box via transport charging outlets;
wherein each of the two wireless earphones comprise a control unit,
wherein the control unit switches off the respective wireless earphone if the respective wireless earphone is inserted into the transport box and thereby connected with the transport charging outlet, and
wherein the control unit does not switch off the respective wireless earphone if the respective wireless earphone is connected with the charging outlet of the charging band.

2. The wireless headphone as set forth in claim 1,
wherein the charging outlets and the charging inputs have electrical charging contacts for energy transmission.

3. The wireless headphone as set forth in claim 1,
wherein the charging outlets and the charging inputs enable inductive or capacitive energy transmission.

4. The wireless headphone as set forth in claim 1,
wherein magnets are provided for attaching each of the charging outlets of the charging band to a charging input of one of the two wireless earphones.

5. The wireless headphone as set forth in one of the preceding claims,
wherein the charging outlets and the charging inputs are configured such that the charging band can be detachably attached to the two wireless earphones.

6. A wireless headphone comprising:
two wireless earphones, each comprising:
a first rechargeable battery;
at least one electro-acoustic transducer for reproduction;
at least one charging input; and
at least one wireless transmitter/receiver; and
a charging band comprising a second battery,
wherein charging outlets are located on a first end and a second end of the charging band,
wherein the charging outlets and the charging inputs are adapted for charging the first rechargeable batteries from the second battery, and
wherein the two wireless earphones are configured to output, via the electro-acoustic transducers, an acoustic signal to a user as soon as charging of the first rechargeable batteries via the charging outlets of the charging band is finished.

7. A charging band for connecting and charging two wireless earphones, comprising:
a battery;
at least two charging outlets that are configured to interact with charging inputs of the two wireless earphones to be charged; and
two cables for connecting the at least two charging outlets with the battery,
wherein the battery is configured to store energy and provide it via the at least two charging outlets to the two wireless earphones connected thereto, so as to charge the two wireless earphones,
wherein the two cables are configured such that the at least two charging outlets may be attached to the two wireless earphones while the two wireless earphones are located in a respective ear of a user;
wherein the charging band is configured to serve as a transport box for the two wireless earphones, and
wherein the charging band enables mobile charging of the two wireless earphones within the transport box via the at least two charging outlets.

8. A wireless headphone comprising:
two wireless earphones, each comprising:
a first rechargeable battery;
at least one electro-acoustic transducer for reproduction;
at least one charging input; and
at least one wireless transmitter/receiver; and
a charging band comprising a second battery,
wherein charging outlets are located on a first end and a second end of the charging band,
wherein the charging outlets and the charging inputs are adapted for charging the first rechargeable batteries from the second battery,
wherein the charging band is configured to serve as a transport box for the two wireless earphones,
wherein the charging band enables mobile charging of the two wireless earphones within the transport box via at least two charging outlets, and
wherein the two cables are configured such that the at least two charging outlets may be attached to the two wireless earphones while the two wireless earphones are located in a respective ear of a user.

9. The wireless headphone as set forth in claim 8, wherein the two wireless earphones each comprise an earpad and a charging input located on a side of the wireless earphone that is opposite to the earpad.

* * * * *